United States Patent [19]

Noe

[11] Patent Number: 4,462,225

[45] Date of Patent: Jul. 31, 1984

[54] APPLIANCE LEVELING AND LOCATING STRUCTURE

[75] Inventor: William J. Noe, Newton, Iowa

[73] Assignee: The Maytag Company, Newton, Iowa

[21] Appl. No.: 491,407

[22] Filed: May 4, 1983

[51] Int. Cl.[3] ..... D06F 29/02

[52] U.S. Cl. ..... 68/3 R; 248/121; 248/650; 248/675

[58] Field of Search ..... 68/3 R, 19.2, 26; 248/121, 650, 675, 678

[56] References Cited

U.S. PATENT DOCUMENTS 2,866,273 12/1958 Geldhof ..... 34/75
2,871,688 2/1959 Geldhof ..... 68/19.2
3,139,744 7/1964 Van Alstyne et al. ..... 68/20
3,611,756 10/1971 Brucken ..... 68/3 R

*Primary Examiner*—Philip R. Coe
*Attorney, Agent, or Firm*—Richard L. Ward

[57] ABSTRACT

A fabric dryer is mounted in an elevated posture above a support surface and a washing machine on a support stand. The support stand includes adjustable members by which the support stand and attached fabric dryer can be leveled and adjusted for proper height with respect to the support surface. Each base member of the support stand is formed from a C-shaped channel and the rear of the washing machine cabinet includes a pair of glide plates which are engageable with the lower flanges of the support stand base members to automatically level the washing machine and locate the top of the washing machine below the fabric dryer.

6 Claims, 8 Drawing Figures

APPLIANCE LEVELING AND LOCATING STRUCTURE

BACKGROUND OF THE INVENTION

This invention relates generally to the field of appliance support structure and more particularly to leveling and locating structure for a washing machine positioned below a stand-mounted fabric dryer. The support structure is cooperable with a portion of the washing machine cabinetry to automatically level and space or locate the rear of the washing machine with respect to the bottom of the fabric dryer cabinet.

Geldhof, U.S. Pat. No. 2,866,273, provides a base member having parallel, spaced-apart, slide rails which form a slidable support for the washing machine. The support feet of the washing machine are positionable on the slide rails to insert or remove the washing machine from beneath the fabric dryer. There are no provisions shown for leveling either the fabric dryer support or the rear of the washing machine.

Van Alstyne et al, U.S. Pat. No. 3,139,744, show support structure for mounting a fabric dryer in an elevated posture and provide adjustable gliders for supporting and leveling the support structure on the floor. The washing machine includes a pair of wheels mounted to the front of the cabinet. The rear of the washing machine and the support structure are tied together by a hydraulically operated rack and pinion system for moving the washing machine between operative and storage postures.

The prior art has thus shown methods of providing for installation and/or removal of a washing machine from below an elevated fabric dryer by providing channels for the washing machine adjustable feet to slide within or by the use of a hydraulic mechanism for moving the washing machine relative to the fabric dryer support structure. There has been no known showing, however, of a stand-mounted fabric dryer with the stand being cooperable with the washing machine cabinetry to provide for the automatic leveling of the rear of the washing machine while also providing for the proper vertical spacing between the cabinets of the fabric dryer and the washing machine.

SUMMARY OF THE INVENTION

It is therefore an object of the instant invention to provide an improved appliance support structure for an elevated fabric dryer and a washing machine cabinet.

It is a further object of the instant invention to provide cooperating structure which will automatically provide for leveling and for proper spacing of the top rear of the washing machine cabinet with respect to the bottom of the fabric dryer cabinet.

Briefly, the instant invention achieves these objects in an appliance leveling and locating structure. First and second appliances are included with each having a cabinet for supporting and generally enclosing the respective appliances. Structure including a pair of generally L-shaped members is provided for supporting the first appliance in an elevated position above a support surface a space sufficient to receive the second appliance therebetween. Each of the L-shaped members includes a generally horizontally extending base member and a generally upright column. First adjustment mechanism is associated with each base member and is operable for vertically adjusting and leveling the first appliance supporting structure with respect to the support surface.

Glide apparatus is mounted on the second appliance cabinet for engaging with the supporting structure to automatically level and locate the rear portion of the second appliance relative to the first appliance. Second adjustment mechanism is associated with the second appliance and is operable for leveling the front of the second appliance.

Construction and characteristics of the appliance leveling and locating structure and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
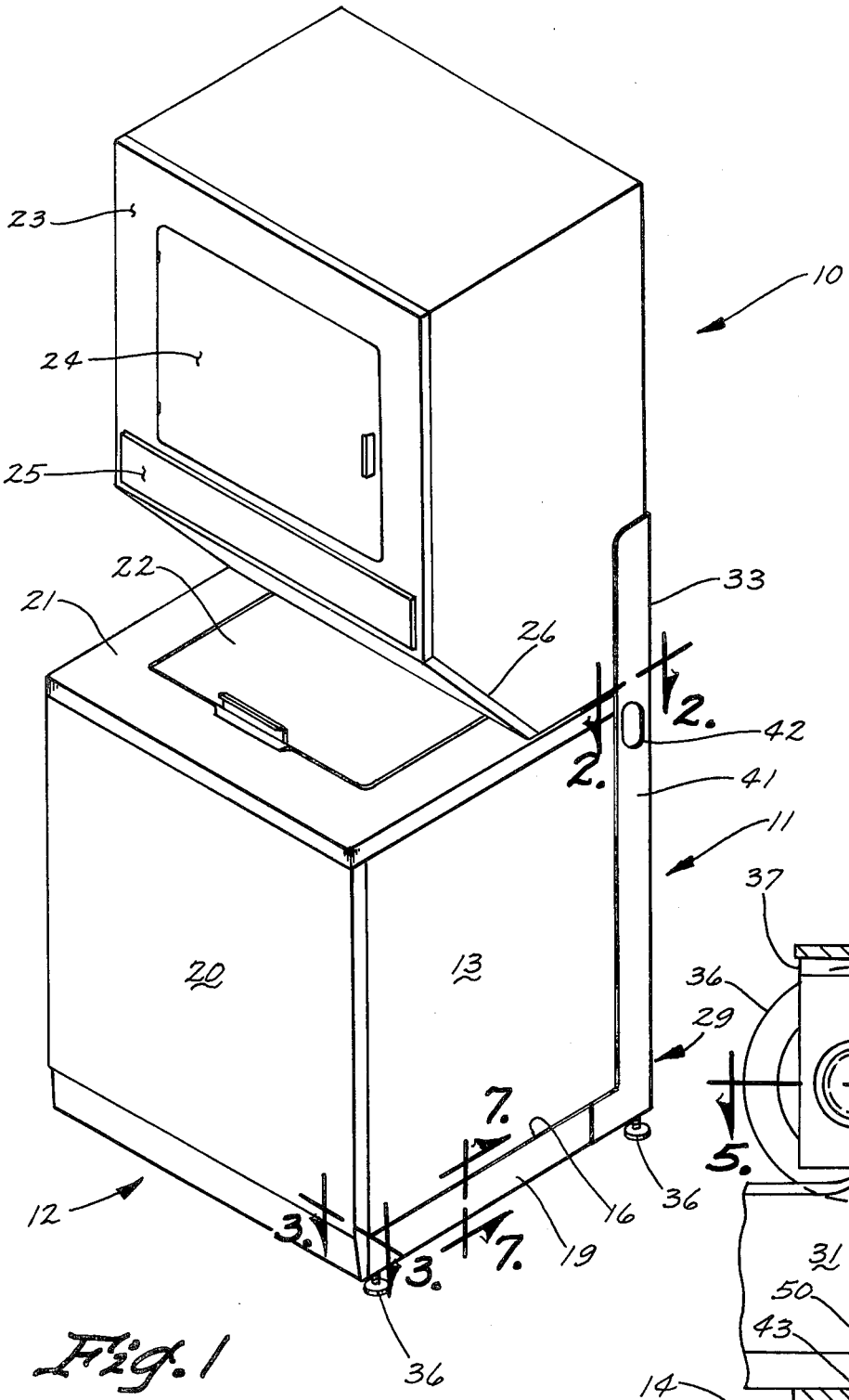
FIG. 1 is an isometric view of a washer/dryer pair mounted in a stack arrangement through supporting structure.

Referring now to the drawings and in particular to FIG. 1, there is shown a pair of laundry appliances with a fabric dryer 10 mounted on an appliance support stand 11 above an automatic washing machine 12.

Figure 3:
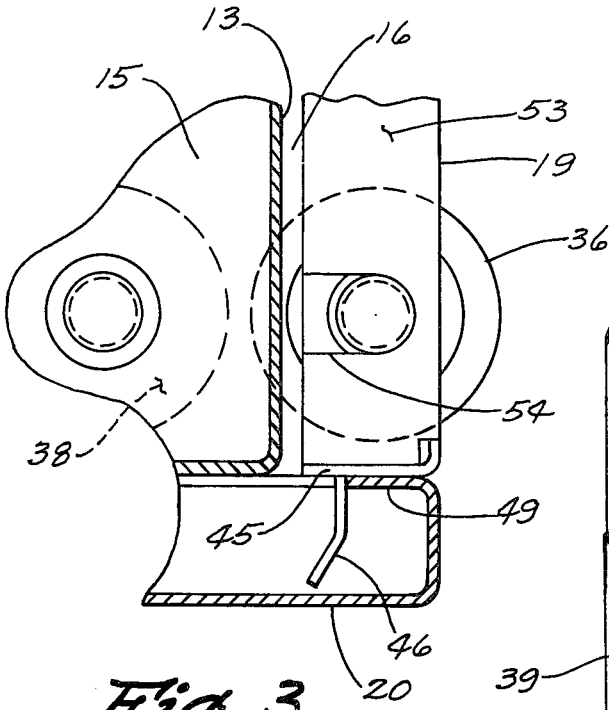
FIG. 3 is a fragmentary section view taken through the front panel of the washer and generally along lines 3—3 of FIG. 1 showing structure joining the base portions of the support stand.
Figure 6:
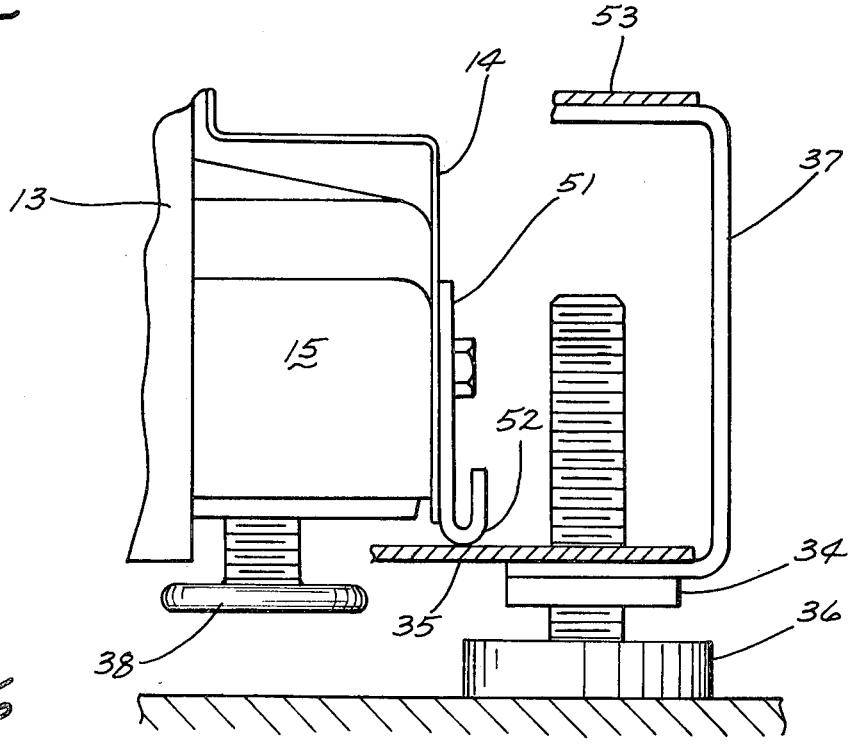
FIG. 6 is a fragmentary section view taken generally along lines 6—6 of FIG. 5.
Figure 7:
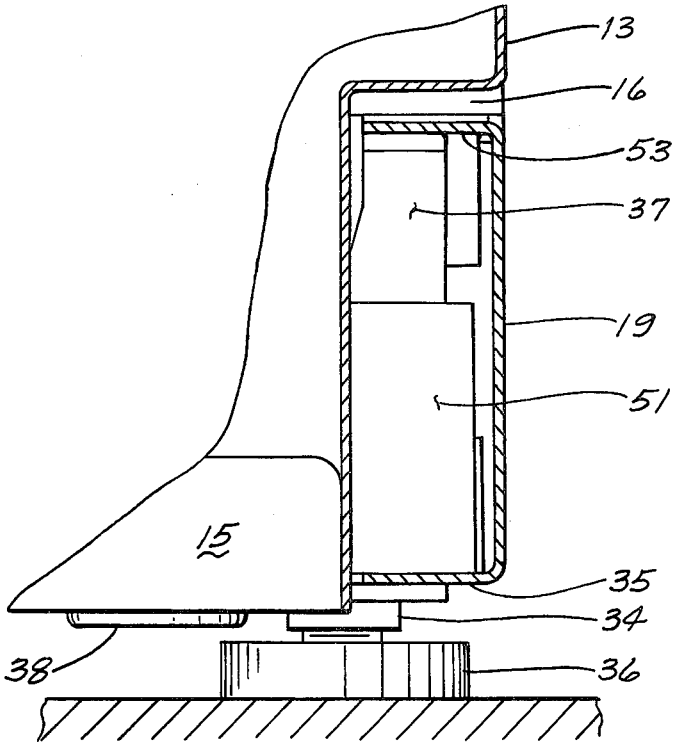
FIG. 7 is a fragmentary section view taken generally along lines 7—7 of FIG. 1.

Briefly, in this embodiment of the invention, the automatic washing machine 12 is housed within a generally rectangular cabinet having a three-sided enclosure member forming the sides 13 and rear 14 of the cabinet and secured to a supporting base pan 15 as best shown in FIGS. 3, 6 and 7. As shown in FIGS. 3 and 7, each side 13 of the enclosure member includes a rectangular recessed area 16 at the bottom and extending from the front to the rear of the washing machine 12 for receiving the base portions 19 of the support stand 11. A vertically oriented front panel 20 completes the peripheral cabinet enclosure including the frontal covering of the bottom recesses 16 on each side of the washing machine cabinet 12 as shown in FIGS. 3 and 7. The cabinetry of the washing machine 12 also includes a substantially horizontal top cover 21 having an access lid 22 for providing access to the interior of the washing machine 12.

The fabric dryer 10 is shown mounted in a cantilevered fashion on the support stand 11 directly above the washing machine 12 and also as a generally rectangular enclosure which is substantially shorter in front-to-rear depth than the washing machine 12. The vertically oriented dryer front panel 23 includes an access door 24 for loading and unloading fabrics to be dried. Controls, such as control panel 25, may be positioned on the dryer 10 and/or washing machine 12 through which the washing machine 12 and dryer 10 are controlled. As further shown in FIG. 1, the lower front panel portion 26 of the dryer 10 tapers rearwardly from a point adjacent the bottom edge of the front panel 23. The lower edge of the dryer lower front panel 26 is adjacent to but spaced slightly above the top cover 21 of the washing machine 12. Within the lower part of the dryer 10 behind the sloping lower front panel 26 is the dryer heater assembly and drive assembly (not shown).

Figure 4:
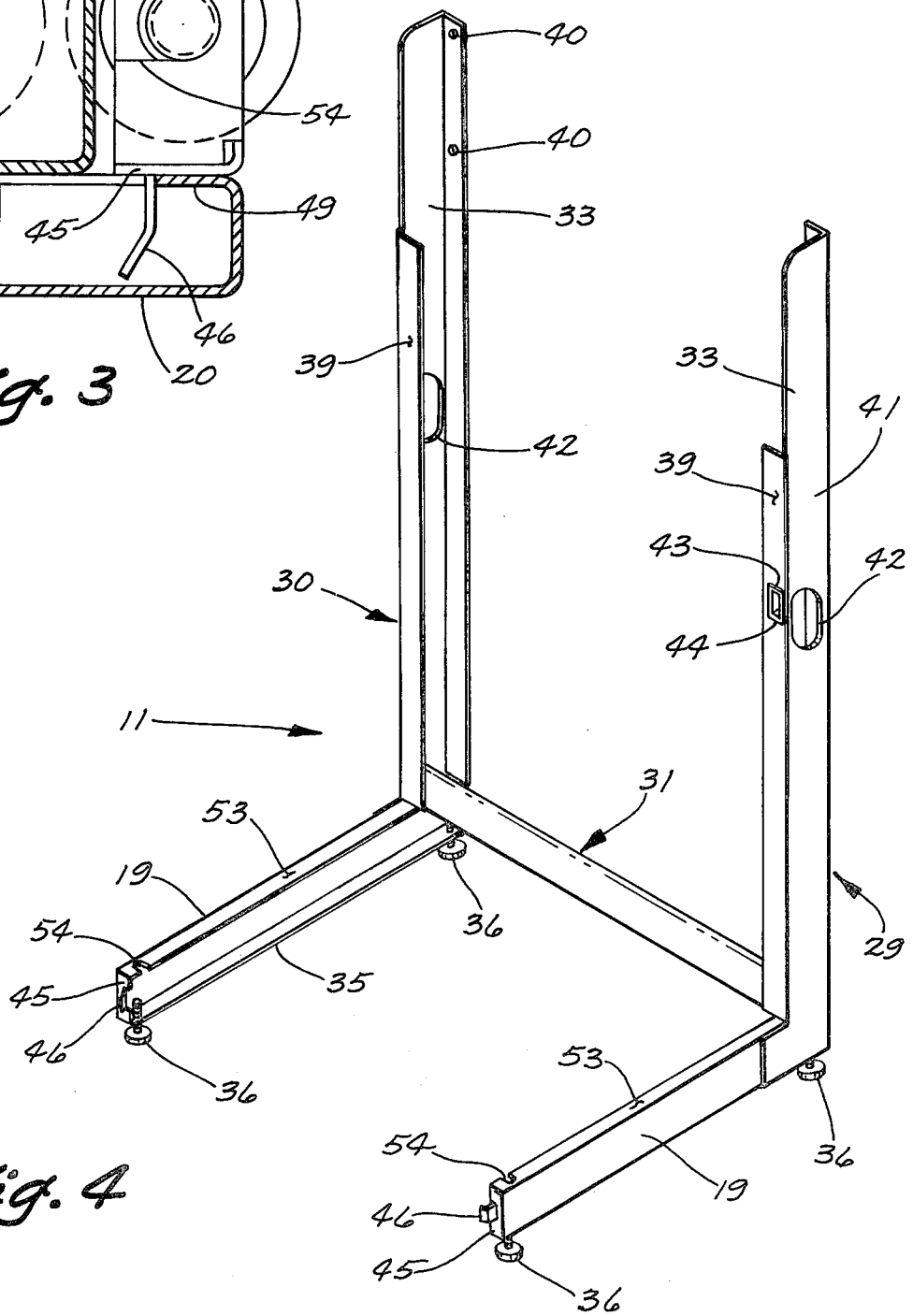
FIG. 4 is an isometric view of the support stand removed from the washer and dryer cabinetry.
Figure 5:
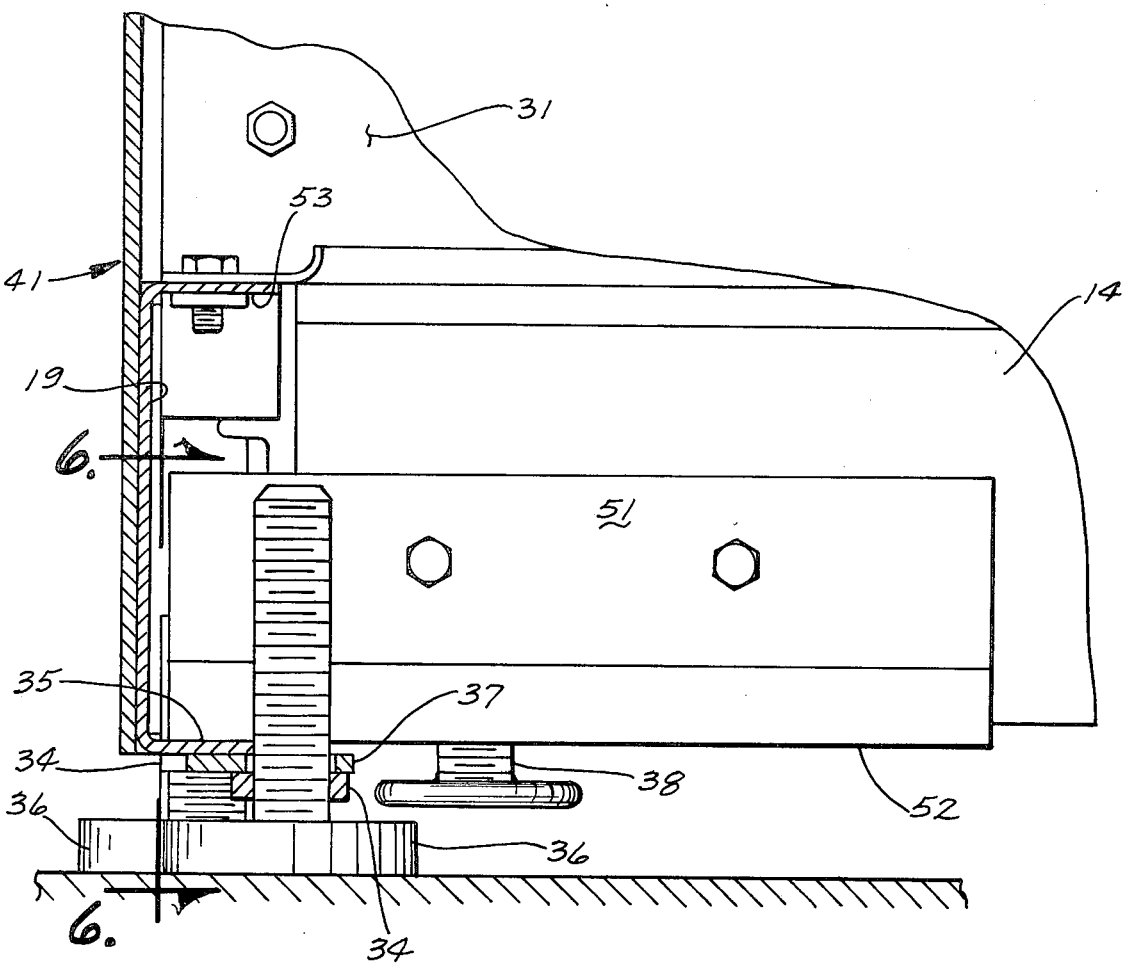
FIG. 5 is a fragmentary section view taken through the base portion of the support stand generally along lines 5—5 of FIG. 2.

Turning now to FIG. 4, there is shown the appliance support stand 11. The appliance support stand 11 is constructed of three main elements which include right and left leg assemblies 29 and 30 and a cross brace 31. The right and left leg assemblies 29 and 30 each include a substantially horizontally extending base portion 19 generally parallel with the supporting surface or floor and a substantially upright column portion 33 which combine to form the L-shaped right and left leg assemblies 29 and 30. In the construction of the instant embodiment, the base portion 19 and the upright column 33 of each leg 29 or 30 are constructed from substantially C-shaped channels which are formed from heavy gauge sheet metal with the upright column 33 being welded to the base portion 19. The open sides of the C-shaped channels which form the leg assemblies 29 or 30 are faced inwardly toward each other as shown in FIG. 4 so that the generally flat side of the channels will be substantially aligned with the vertical sides of the washing machine 12 and dryer 10 as shown in FIG. 1. As best shown in FIGS. 5–7, each base portion 19 further includes a pair of spaced-apart weld nuts 34 welded to the underside of the lower leg or flange 35 of the C-shaped channel for receiving adjustable feet 36 as shown in FIG. 4. These adjustable feet 36 are used to level and adjust the height of the support stand 11 with respect to the floor or supporting surface. As generally indicated in the fragmentary section view of FIG. 3 and in FIGS. 5 and 6, the base support pan 15 of the washing machine 12 includes an adjustable foot 38 at each corner for independently leveling and adjusting the height of the washing machine 12.

Referring again to FIG. 4, the upright columns 33 each have the upper portion of the forwardly facing leg or flange 39 of the C-shaped channel notched for receiving the dryer 10 in the manner of FIG. 1. The dryer 10 is secured at the top of and between the pair of upright columns 33 by threaded fasteners (not shown) which extend through the apertures 40 in each of the upright columns 33 as shown in FIG. 4.

As further shown in FIG. 4, the side wall 41 of each upright column 33 includes an elongated opening or slot 42 for passing various service lines such as natural gas, electricity and water. In addition, the right-hand upright column includes, in the forwardly facing leg 39 of the C-shaped channel, a generally rectangular slot 43 for receiving a thermoplastic grommet 44. The purpose of this grommet 44 will be discussed further herein.

In this embodiment of the invention, the cross brace 31, having a substantially L-shaped cross section, is bolted to the two leg assemblies 29 and 30 to form the support stand 11. Alternatively, the cross brace 31 could be welded to the leg assemblies 29 and 30 thus forming a permanent assembly of the support stand 11. The bolted construction is, however, preferred since it facilitates handling both in manufacturing and shipping.

As best shown in FIG. 3, each base portion 19 has a front wall 45 which includes a tab or finger 46 that extends forwardly and angles inwardly. When the washing machine 12 is positioned between the right and left leg assemblies 29 and 30 of the support stand 11 so that the base portions 19 of the right and left leg assemblies 29 and 30 are within the rectangular recesses 16 of the washing machine 12, the tabs or fingers 46 will engage with the return flanges 49 of the front panel 20 to structurally tie together the base portions 19. This will keep the base portions 19 of the leg assemblies 29 and 30 from spreading away from the washing machine 12 after the washing machine 12 has been properly positioned between the base portions 19.

Figure 2:
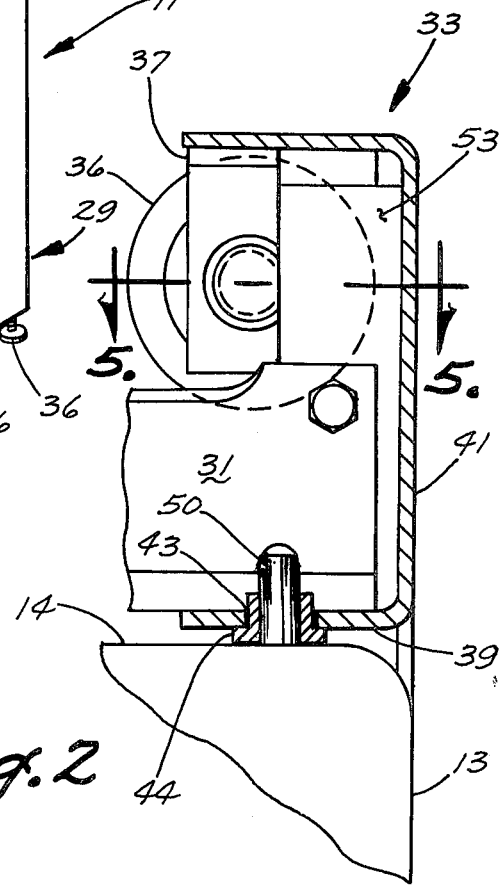
FIG. 2 is a fragmentary section view showing a portion of the support stand and the washer cabinet taken generally along lines 2—2 of FIG. 1.

As further shown in FIG. 2, the upper right rear corner of the washing machine 12 includes a cylindrical pilot pin 50 which extends rearwardly from the washing machine 12. When the washing machine 12 is operably positioned with respect to the support stand 11, the pilot pin 50 will engage with the previously discussed thermoplastic grommet 44 in the forwardly facing leg 39 of the upright column 33. This pilot pin 50 serves as a locating device for the washing machine 12 and also stabilizes the dryer 10 and support stand 11 in a side-to-side direction.

Referring now to FIGS. 5 and 6, there are shown views of the lower right rear corner of the washing machine 12 and the support stand 11. In this embodiment of the invention, a sheet metal glide plate 51 having an upwardly opening U-shaped lower edge 52 is bolted through the rear cabinet wall 14 of the washing machine 12 and into the supporting base pan 15. This glide plate 51 is positioned so that the U-shaped lower edge 52 extends below the bottom of the washing machine 12 and support pan 15. An identical glide plate 52 is bolted to the left rear corner of the washing machine 12 and as further shown in FIGS. 5 and 6 the glide plates 51 extend outwardly from the recessed edge of the washing machine 12 and are engageable with the lower legs or flanges 35 of the C-shaped channels which define the base portions 19 of the support stand 11. A channel stiffener bracket 37 is attached across the rear of each base portion 19 for supporting the added weight of the washing machine 12 on the lower legs or flanges 35.

The washing machine 12 equipped with a pair of glide plates 51 for engaging with the base portions 19 may be positioned relative to the support stand 11 in the following manner: the support stand 11 with attached fabric dryer 10 is positioned for operation and the adjustable feet 36 of the support stand 11 are adjusted to level the support stand 11 as well as to provide the proper vertical distance for the base portions 19 from the floor or supporting surface. If the support stand 11 and fabric dryer 10 are located in an environment which is nonrestrictive with respect to side-to-side movement, the base portions 19 of the leveled support stand 11 can be spread sideways sufficiently to allow the washing machine 12 with the sideways extending glide plates 51 to be positioned between the base portions 19. Once the rear of the washing machine 12 is positioned with the glide plates 51 engaging with the lower legs or flanges 35 of the C-shaped channels, the washing machine 12 can be moved rearwardly into its operable position below the fabric dryer 10. Positioning the washing machine mounted glide plates 51 on the lower legs or flanges 35 of the C-shaped channels will automatically level the rear of the washing machine 12 and will automatically provide the proper spacing between the top cover 21 of the washing machine 12 and the lower front panel 26 of the fabric dryer 10. When the washing machine 12 has been properly positioned, the front adjustable feet 38 can be adjusted to level the front of the washing machine 12. The rear adjustable feet 38 of the washing machine 12, in this embodiment, are shown in an elevated posture just below the glide plates 51 and are used primarily as skids for sliding the washing machine 12 into position between the base portions 19 of the support stand 11.

FIGS. 3 and 4 show the top legs or flanges 53 of the C-shaped channels with inwardly facing slots or notches 54 above the front adjustable feet 36. If the support stand 11 and fabric dryer 10 are located in a restricted area where cabinets or other structure would prevent sideways movement of the base portions 19, the sideways extending glide plates 51 mounted on the washing machine 12 can be guided downwardly through the slots or notches 54 and onto the lower legs or flanges 35 of the base portions 19.

Figure 8:
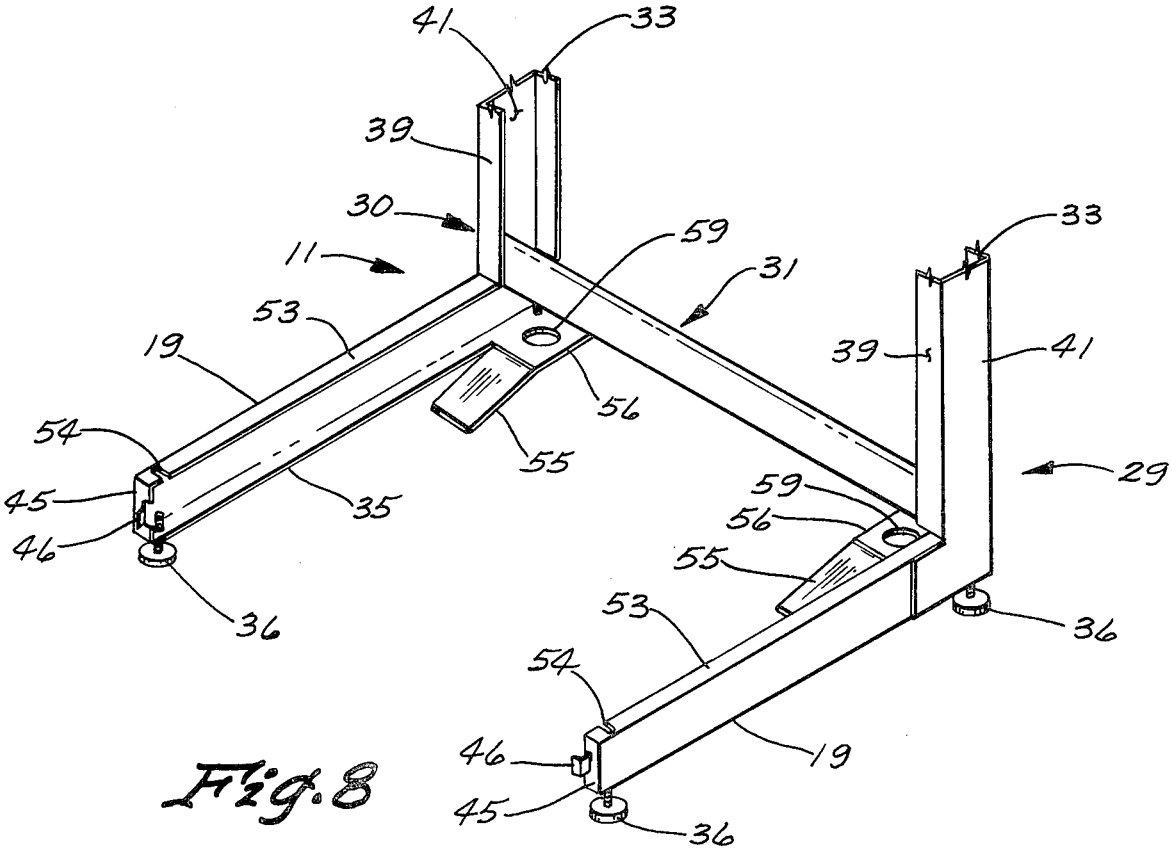
FIG. 8 is a partial isometric view similar to FIG. 4 and showing an alternate construction of the support stand.

Shown in FIG. 8 is an alternate embodiment of the support stand 11. In this alternate embodiment, the rear of each of the lower legs or flanges 35 of the base portions 19 have been extended inwardly to form a ramp segment 55 and a horizontal section 56 having a generally circular depressed area or detent 59. The ramp sements 55 facilitate movement of the washing machine 12 onto the horizontal section 56. When the washing machine 12, without glide plates 51, is positioned relative to the support stand 11, the rear adjustable feet 38 of the washing machine 12 will rest in the depressed areas or detents 59 of the horizontal sections 56 which will again positively locate the top cover 21 of the washing machine 12 with respect to the lower front panel 26 of the dryer 10 and automatically level the rear of the washing machine 12 in much the same manner as with the use of the glide plates 51.

Thus, the combination of support stand, fabric dryer and washing machine shown herein with glide plates attached to the washing machine and engageable with the lower legs of the base portions of the support stand forms a unique structure where the rear of the washing machine is automatically leveled and located with respect to the fabric dryer cabinet.

In the drawings and specification, there is set forth a preferred embodiment of the invention and although specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as defined in the following claims.

I claim:

1. Appliance leveling and locating structure, the combination comprising: first and second appliances each having cabinet means for supporting and generally enclosing the respective appliances; means including a pair of generally L-shaped members for supporting said first appliance in an elevated position above a support surface a space sufficient to receive said second appliance therebetween, each of said L-shaped members comprising a generally horizontally extending base member engageable with said support surface and a generally upright column fixed to said first appliance; first adjustable means associated with each base member and operable for vertically adjusting and leveling said first appliance supporting means with respect to said support surface; means mounted on said second appliance cabinet means for engaging with said means for supporting to automatically level and locate the rear portion of said second appliance relative to said first appliance; and second adjustable means associated with said second appliance and operable for leveling the front of said second appliance.

2. Appliance leveling and locating structure as defined in claim 1 wherein said base member of said means for supporting comprises a C-shaped channel having a lower flange and an upper flange.

3. Appliance leveling and locating structure as defined in claim 2 wherein said means for engaging includes glide means mounted on each side of said second appliance cabinet means and engageable with the lower flange of said C-shaped channels.

4. Appliance leveling and locating structure, the combination comprising: first and second appliances each having cabinet means for supporting and generally enclosing the respective appliances; means including a pair of generally L-shaped members for supporting said first appliance in an elevated position above a support surface a space sufficient to receive said second appliance therebetween, each of said L-shaped members comprising a generally horizontally extending base member engageable with said support surface and having a substantially C-shaped cross section with a lower flange and an upper flange and a generally upright column, said first appliance supporting means further including means for effectively joining said L-shaped members in a generally vertical predetermined spaced-apart posture; first adjustable means associated with the lower flange of each base member and operable for vertically adjusting and leveling said first appliance supporting means with respect to said support surface; glide means mounted on said second appliance cabinet means and engageable with said lower flange of said base members to automatically level and locate the rear portion of said second appliance with respect to said first appliance; and second adjustable means associated with the front of said second appliance and operable for leveling the front of said second appliance.

5. Appliance leveling and locating structure as defined in claim 4 wherein said glide means includes an outwardly extending plate member on each side of said second appliance cabinet means and having an upwardly turned U-shaped section adapted for sliding engagement with the lower flanges of said base members when positioning said second appliance with respect to said first appliance.

6. Appliance leveling and locating structure as defined in claim 5 and further including a slot in the upper flange of each of said C-shaped base members for allowing downward movement of said outwardly extending plates onto said lower flanges when positioning said second appliance with respect to said first appliance.

* * * * *